US008247718B2

(12) United States Patent
Mao et al.

(10) Patent No.: US 8,247,718 B2
(45) Date of Patent: Aug. 21, 2012

(54) BUTTON STRUCTURE AND RELATED ELECTRONIC DEVICE

(75) Inventors: Zhong-hui Mao, Taipei Hsien (TW); Chia-Hsin Hsieh, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 237 days.

(21) Appl. No.: 12/875,104

(22) Filed: Sep. 2, 2010

(65) Prior Publication Data

US 2011/0062007 A1 Mar. 17, 2011

(30) Foreign Application Priority Data

Sep. 15, 2009 (CN) ..... 2009 1 0177533

(51) Int. Cl.
*H01H 13/00* (2006.01)

(52) U.S. Cl. ..... 200/296; 200/341; 200/343; 200/345

(58) Field of Classification Search ..... 200/520, 200/296, 329–330, 341–345; 341/22; 345/168, 345/169

See application file for complete search history.

(56) References Cited

U.S. PATENT DOCUMENTS

| | | | | |
|---|---|---|---|---|
| 3,939,318 | A * | 2/1976 | Brown et al. | 200/521 |
| 4,145,589 | A * | 3/1979 | Albrechtsen | 200/341 |
| 4,638,151 | A * | 1/1987 | Suwa | 235/145 R |
| 5,117,075 | A * | 5/1992 | Guilleminot | 200/343 |
| 6,002,093 | A * | 12/1999 | Hrehor et al. | 200/345 |
| 6,160,232 | A * | 12/2000 | Lin | 200/341 |
| 6,570,112 | B2 * | 5/2003 | Lin | 200/343 |
| 7,868,872 | B2 * | 1/2011 | Tseng | 345/168 |
| 2007/0144885 | A1 * | 6/2007 | Nakatani et al. | 200/520 |
| 2009/0159411 | A1 * | 6/2009 | Guo et al. | 200/296 |

* cited by examiner

*Primary Examiner* — Michael Friedhofer
(74) *Attorney, Agent, or Firm* — Winston Hsu; Scott Margo

(57) ABSTRACT

A button structure for actuating a switch includes a pressing part, a protruding part connected to a side of the pressing part for being driven to actuate the switch when the pressing part is pressed, and a constraining part. An end of the constraining part is connected to the pressing part in an elastically deformable manner. A guiding slot is formed on the constraining part. The button structure further includes a fixing part. An end of the fixing part is disposed inside the guiding slot. The guiding slot slides relative to the fixing part when the pressing part is pressed.

20 Claims, 3 Drawing Sheets

BUTTON STRUCTURE AND RELATED ELECTRONIC DEVICE

BACKGROUND OF THE INVENTION

1. Field of the Invention

The present invention relates to a button structure and a related electronic device, and more particularly, to a button structure for actuating a switch stably without deviating a button from an initial position and a related electronic device.

2. Description of the Prior Art

In order to simplify a button structure of a consumer electronic product, a conventional button structure utilizes an elastic recovering force to recover a button to an initial position when the button is released from a pressed position. The conventional button structure can utilize a single pair of cantilevers made of elastic material, and one end of each cantilever is connected to the button and the other end of the cantilever is fixed on other structural components, such as being fixed on other structural components in a heat melt manner. When the button is pressed, the cantilevers are stretched in an elastically deformable manner, so that the button can be pressed for actuating a switch to output a control signal. When pressure on the button is released, the cantilevers provide the elastic recovering force to the button, so that the button recovers to the initial position. However, it has a drawback that different cantilevers have different elastic deformation resulting that the button is deviated from a predetermined track easily when pressing and releasing the button. In addition, the cantilevers fixed on the structural components in the heat melt manner can not be recycled and reused. If the button structure utilizes multiple pairs of cantilevers to be fixed on the button, more force is needed to press the button for overcoming elastic force of the multiple pairs of cantilevers. Furthermore, the conventional button structure can further include an elastic component disposed between the button and the switch, which can prevent the button from deviating when the button is pressed and released. However, this conventional button structure has higher manufacturing cost and complicated assembly. Thus, design of a button structure capable of preventing the button from deviating when the button is pressed and released and having simply assembly for economizing labor hours and manufacturing cost is an important issue in the electronic industry.

SUMMARY OF THE INVENTION

The present invention provides a button structure for actuating a switch stably without deviating a button from an initial position and a related electronic device for solving above drawbacks.

According to the claimed invention, a button structure includes a pressing part, a protruding part connected to a side of the pressing part for actuating a switch when the pressing part is pressed, a constraining part, an end of the constraining part being connected to the pressing part in an elastically deformable manner, a guiding slot being formed on the constraining part, and a fixing part, an end of the fixing part being disposed inside the guiding slot, the guiding slot sliding relative to the fixing part when the pressing part is pressed.

According to the claimed invention, the button structure further includes a supporting part disposed on a side of the fixing part for supporting the constraining part when the pressing part is pressed.

According to the claimed invention, the constraining part is for providing an elastic recovering force to the pressing part so that the pressing part recovers to an initial position when the pressing part is not pressed.

According to the claimed invention, the guiding slot is for guiding sliding movement of the constraining part relative to the fixing part so as to prevent the pressing part from deviating when the pressing part is pressed.

According to the claimed invention, an electronic device includes a panel, a switch disposed on a base, and a button structure for actuating the switch. The button structure includes a pressing part, a protruding part connected to a side of the pressing part for actuating the switch when the pressing part is pressed, a constraining part, an end of the constraining part being connected to the pressing part in an elastically deformable manner, a guiding slot being formed on the constraining part, and a fixing part, an end of the fixing part being disposed inside the guiding slot and the other end of the fixing part being connected to the panel, the guiding slot sliding relative to the fixing part when the pressing part is pressed.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
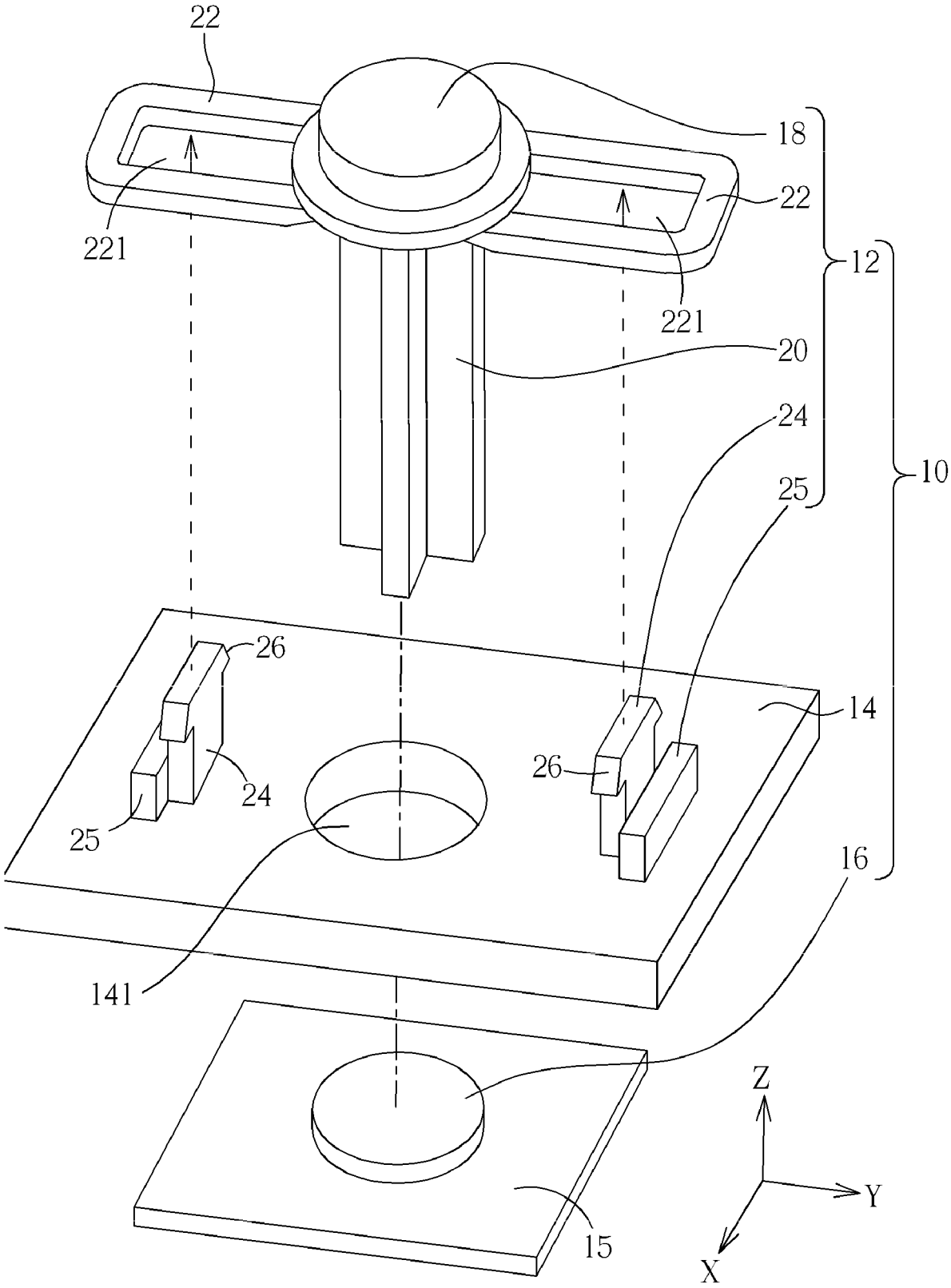
FIG. 1 is a diagram of an electronic device according a preferred embodiment of the present invention.

Please refer to FIG. 1. FIG. 1 is a diagram of an electronic device 10 according a preferred embodiment of the present invention. The electronic device 10 includes a button structure 12, a panel 14, and a switch 16 disposed on a base 15. The base 15 can be a printed circuit board. The button structure 12 is for actuating the switch 16. The button structure 12 includes a pressing part 18, a protruding part 20 connected to a side of the pressing part 18, and two constraining parts 22. One end of each constraining part 22 can be connected to the pressing part 18 in an elastically deformable manner, and a guiding slot 221 is formed on the constraining part 22. The pressing part 18 can be integrated with the protruding part 20 monolithically. The constraining part 22 can be integrated with the pressing part 18 monolithically. The constraining part 22 also can be connected to the pressing part 18 in a heat melt manner or be adhered to the pressing part 18.

A guiding hole 141 is formed on the panel 14, and the switch 16 is disposed on a side of the guiding hole 141. The protruding part 20 can be driven to pass through the guiding hole 141 so as to actuate the switch 16 when a user presses the pressing part 18, and the switch 16 can output a corresponding control signal after being actuated. The button structure 12 further includes two fixing parts 24. One end of each fixing part 24 is disposed inside the corresponding guiding slot 221, and the other end of the fixing part 24 is connected to the panel 14, so that the button structure 12 does not move in X direction when the pressing part 18 is pressed. The button structure 12 further includes two supporting parts 25 disposed on a side of the two fixing parts 24, respectively, for supporting the constraining parts 22 when the pressing part 18 is pressed, so that the constraining parts 22 do not fall on the panel 14. In addition, the fixing parts 24 can include a hook structure 26 for wedging inside the guiding slot 221 so that the constraining part 22 can slide relative to the fixing parts 24. That is to say, when the button structure 12 is pressed, a relative angle between the pressing part 18 and the constraining part 22 is changed according to a route of the button structure 12. The fixing parts 24, the supporting parts 25, the hook structures 26, and the panel 14 can be integrated one another monolithically.

Figure 2:
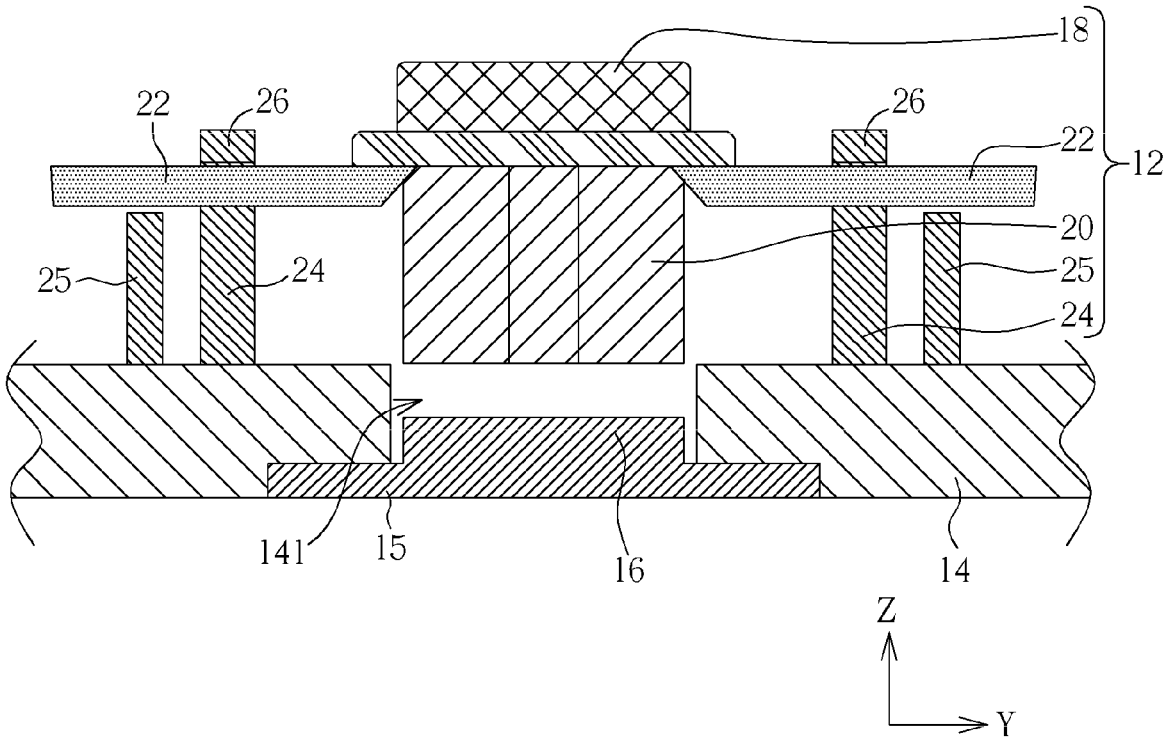
FIG. 2 is a diagram of a button structure having not been pressed according to the preferred embodiment of the present invention.
Figure 3:
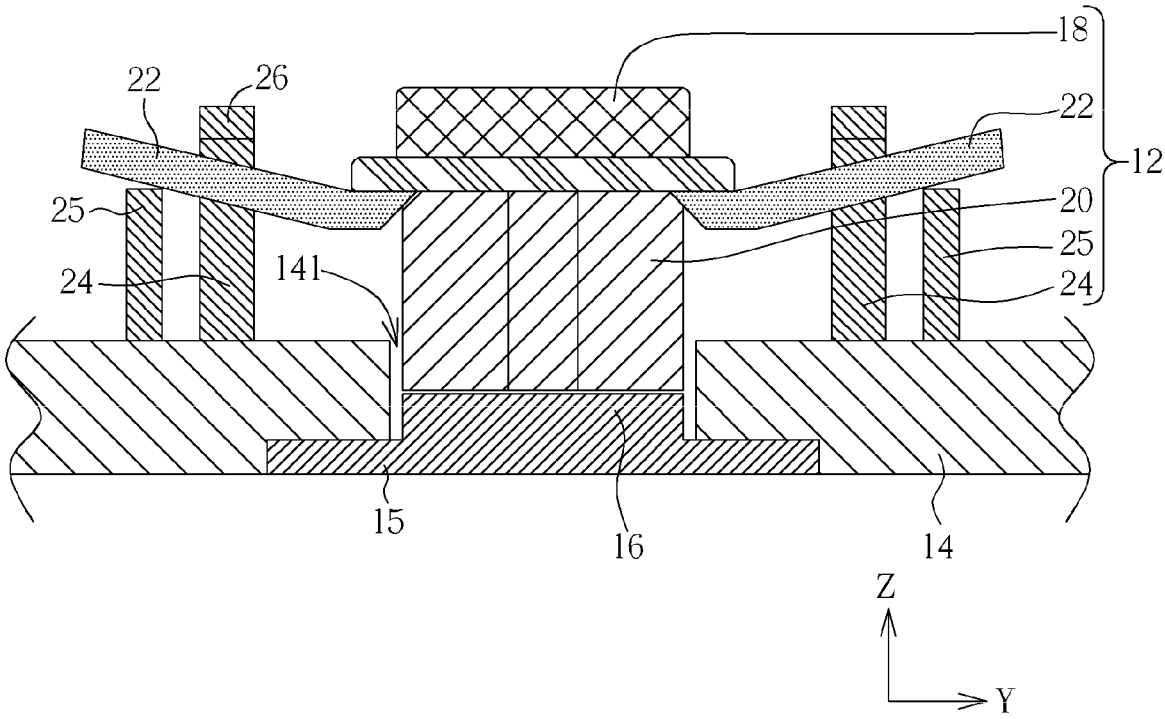
FIG. 3 is a diagram of the button structure having been pressed according to the preferred embodiment of the present invention.

Please refer to FIG. 1 to FIG. 3. FIG. 2 is a diagram of the button structure 12 having not been pressed according to the preferred embodiment of the present invention. FIG. 3 is a diagram of the button structure 12 having been pressed according to the preferred embodiment of the present invention. As shown in FIG. 2, when the pressing part 18 is not pressed, an end of the constraining part 22 is connected to the pressing part 18 and the other end of the constraining part 22 is disposed between the fixing part 24 and the supporting part 25, which means the constraining part 22 is substantially level, so as to keep the pressing part 18 in an initial position. As shown in FIG. 3, when the pressing part 18 is pressed to move in Z direction, an end of the constraining part 22 is connected to the pressing part 18 and the other end of the constraining part 22 is suspended. The guiding slot 221 is formed on middle of the constraining part 22. When the pressing part 18 moves downward or upward in Z direction, the guiding slot 221 can move relative to the fixing part 24, the supporting part 25, and the hook structure 26 of the panel 14 in Y direction. That is to say, the fixing part 24, the supporting part 25, and the hook structure 26 of the panel 14 can constrain the constraining part 22 to move only in Y direction. Meanwhile, the guiding hole 141 on the panel 14 can constrain the protruding part 20 to move upward or downward in Z direction. Therefore, the button structure 12 only moves in Y direction and in Z direction so as to prevent the pressing part 18 from twisting or deflecting when the pressing part 18 is pressed. The protruding part 20 connected to a side of the pressing part 18 can move in a predetermined track to actuate the switch 16 for outputting the corresponding control signal.

As shown in FIG. 2 and FIG. 3, when the pressing part 18 is pressed, the constraining part 22 only can move relative to the fixing part 24, the supporting part 25, and the hook structure 26 in Y direction, so that the pressing part 18 does not deflect from X direction. The guiding hole 141 on the panel 14 constrains the protruding part 20 to move downward or upward in Z direction, so that the pressing part 18 does not deflect from Y direction. In addition, when releasing pressure on the pressing part 18, the constraining part 22 can provide an elastic recovering force to the pressing part 18, so that the pressing part 18 is recovered to the initial position. At this time, the guiding slot 221 can guide the constraining part 22 to slide relative to the fixing part 24, and can further constrain the constraining part 22 to move in Y direction and in Z direction. The constraining part 22 is unable to move in X direction and can prevent the pressing part 18 from deflecting or twisting when the pressing part 18 is recovered to the initial position.

In addition, the constraining part 22 can be made of elastic material. When the pressing part 18 is pressed to move in Z direction, a joint of the constraining part 22 and the pressing part 18 is elastically deformed, so that an end of the constraining part 22 not connected to the pressing part 18 can rotate relative to the pressing part 18 in the YZ plane. The constraining part 22 also can be pivoted to the pressing part 18. A structural design capable of rotating the constraining part 22 relative to the pressing part 18 is within the scope of the present invention. Furthermore, a component made of elastic material can further be disposed on the joint of the constraining part 22 and the pressing part 18 or between the constraining part 22 and the fixing part 23, so as to provide the elastic recovering force to the pressing part 18 for recovering the pressing part 18 to the initial position. Mechanism for providing the elastic recovering force to recover the pressing part 18 to the initial position is not limited to the above-mentioned embodiment and depends on design demand.

Because the constraining part 22 can be made of elastic material, the guiding slot 221 on the constraining part 22 can be wedged with the hook structure 26 by the elastic recovering force so as to slide relative to the fixing part 24. The button structure 12 can not only be operated easily but also be assembled conveniently. In addition, numbers and positions of the constraining part 22 and the fixing part 24 are not limited to the embodiment and depend on actual demand. For example, a plurality of constraining parts 22 and a plurality of fixing parts 24 can be disposed so as to increase sliding stability of the guiding slot 221 when the pressing part 18 is pressed. Furthermore, connection of the constraining part 22 and the fixing part 24 is not limited to the above-mentioned embodiment and depends on actual demand. For example, a part of the guiding slots 221 on the plurality of constraining parts 22 can be disposed on the corresponding fixing parts 24 in a slidable manner, and the other part of the guiding slots 221 on the plurality of constraining parts 22 can be fixed on the corresponding fixing parts 24 selectively.

Comparing to the prior art, the button structure of the present invention forms the guiding slot on the constraining part, so that the constraining part can slide relative to the fixing part and the supporting part when the pressing part is pressed. The button structure of the present invention can prevent the button from twisting and deflecting unexpectedly, so as to prevent the button from deviating from the predetermined track in the pressing route. Thus, the button structure of the present invention improves assembly convenience and increases operating stability.

Those skilled in the art will readily observe that numerous modifications and alterations of the device and method may be made while retaining the teachings of the invention.

What is claimed is:

1. A button structure comprising:

a pressing part;

a protruding part connected to a side of the pressing part for actuating a switch when the pressing part is pressed;

a constraining part, an end of the constraining part being connected to the pressing part in an elastically deformable manner, a guiding slot being formed on the constraining part; and a fixing part, an end of the fixing part being disposed inside the guiding slot, the guiding slot sliding relative to the fixing part when the pressing part is pressed.

2. The button structure of claim 1 further comprising:

a supporting part disposed on a side of the fixing part for supporting the constraining part when the pressing part is pressed.

3. The button structure of claim 1, wherein the constraining part is made of elastic material.

4. The button structure of claim 3, wherein a joint of the constraining part and the pressing part is elastically deformed when the pressing part is pressed.

5. The button structure of claim 4, wherein the constraining part is for providing an elastic recovering force to the pressing part so that the pressing part recovers to an initial position when the pressing part is not pressed.

6. The button structure of claim 1, wherein the guiding slot is for guiding sliding movement of the constraining part relative to the fixing part so as to prevent the pressing part from deviating when the pressing part is pressed.

7. The button structure of claim 1, wherein the constraining part is pivoted to the pressing part.

8. The button structure of claim 1, wherein the fixing part comprises a hook structure for wedging inside the guiding slot.

9. The button structure of claim 1, wherein the pressing part is integrated with the protruding part monolithically.

10. The button structure of claim 1, wherein the constraining part is heat melted or adhered to the pressing part.

11. An electronic device comprising:

a panel;

a switch disposed on a base; and a button structure for actuating the switch, the button structure comprising:

a pressing part;

a protruding part connected to a side of the pressing part for actuating the switch when the pressing part is pressed;

a constraining part, an end of the constraining part being connected to the pressing part in an elastically deformable manner, a guiding slot being formed on the constraining part; and a fixing part, an end of the fixing part being disposed inside the guiding slot and the other end of the fixing part being connected to the panel, the guiding slot sliding relative to the fixing part when the pressing part is pressed.

12. The electronic device of claim 11, wherein the button structure further comprises a supporting part disposed on a side of the fixing part for supporting the constraining part when the pressing part is pressed.

13. The electronic device of claim 11, wherein the constraining part is made of elastic material.

14. The electronic device of claim 13, wherein a joint of the constraining part and the pressing part is elastically deformed when the pressing part is pressed.

15. The electronic device of claim 13, wherein the constraining part is for providing an elastic recovering force to the pressing part so that the pressing part recovers to an initial position when the pressing part is not pressed.

16. The electronic device of claim 11, wherein the guiding slot is for guiding sliding movement of the constraining part relative to the fixing part so as to prevent the pressing part from deviating when the pressing part is pressed.

17. The electronic device of claim 11, wherein the constraining part is pivoted to the pressing part.

18. The electronic device of claim 11, wherein the fixing part comprises a hook structure for wedging inside the guiding slot.

19. The electronic device of claim 11, wherein the pressing part is integrated with the protruding part monolithically.

20. The electronic device of claim 11, wherein a guiding hole is formed on the panel, and the protruding part passes through the guiding hole to actuate the switch when the pressing part is pressed.

* * * * *